US005112255A

United States Patent [19]

Daley, Jr.

[11] Patent Number: 5,112,255

[45] Date of Patent: May 12, 1992

[54] JOINER AND METHOD OF JOINING TERMINAL STRIP SEGMENTS

[75] Inventor: Eugene E. Daley, Jr., Fort Wayne, Ind.

[73] Assignee: United Technologies Automotive, Dearborn, Mich.

[21] Appl. No.: 677,916

[22] Filed: Apr. 1, 1991

[51] Int. Cl.[5] ..... H01R 13/02

[52] U.S. Cl. ..... 439/885; 24/459; 24/575; 29/876

[58] Field of Search ..... 24/459, 573, 575; 29/402.9, 876, 884; 439/885, 894

[56] References Cited

U.S. PATENT DOCUMENTS

| | | | |
|---|---|---|---|
| 2,796,648 | 6/1957 | Peterson | 24/459 X |
| 3,109,212 | 11/1963 | Emery | 24/573 X |
| 3,431,548 | 3/1969 | Busler | 439/885 |
| 4,771,516 | 9/1988 | Foth | 24/459 |

FOREIGN PATENT DOCUMENTS

| | | | |
|---|---|---|---|
| 1026120 | 4/1953 | France | 24/575 |

*Primary Examiner*—Neil Abrams
*Assistant Examiner*—Khiem Nguyen
*Attorney, Agent, or Firm*—George J. Romanik

[57] ABSTRACT

A joiner capable of joining two terminal strip segments together in a consistent manner which permits the joiner to be automatically detected against a background of a continuous strip of terminals by a terminal insertion machine has two identical, hermaphroditic joiner halves. Each joiner half has an optically detectable solid body, means for engaging a terminal strip segment, and means for securely grasping another joiner half. Two terminal strip segments can be joined with the joiner by engaging an end of a first terminal strip segment with a means for engaging a terminal strip segment on a first joiner half, while engaging an end of a second terminal strip segment with a means for engaging a terminal strip segment on a second joiner half. A joint is formed between the first and second terminal strip segments by securely grasping the first and second joiner halves together.

8 Claims, 2 Drawing Sheets

JOINER AND METHOD OF JOINING TERMINAL STRIP SEGMENTS

TECHNICAL FIELD

The present invention is directed towards a device and method for joining ends of electrical terminal strips.

BACKGROUND ART

Electrical connectors are used in many industries, including the automotive industry, to make electrical connections between various devices and power sources. For example, in the automotive industry such connectors may be used to connect airbag crash sensors with airbag actuation devices, to connect radios with speakers and a power source, or for numerous other uses. Connectors are typically used in such large quantities that automatic assembly of them is highly desirable.

An electrical connector typically comprises electrically conductive male or female terminals positioned in a plastic housing. The terminals may be either bare metal or may be plated with gold, nickel, or another metal to enhance their conductivity. Typically, terminals are stamped in a continuous strip, with each individual terminal connected to adjacent terminals by a thin metal segment or a continuous band of thin metal. The terminal strips may be wound onto supply reels to facilitate the automatic assembly of the connectors. Reels with strips of 2,000 to 20,000 terminals are common.

Frequently, breaks in the continuous terminal strips are formed during manufacture, for example, when terminal strip raw materials are exhausted or changed or when processing problems are encountered while winding the strips onto a supply reel. These breaks create smaller terminal strip segments which can be joined together to maintain a continuous strip of terminals on the supply reels. At times it is also desirable to join terminal strips which have not broken, but which, for one reason or another, are shorter than desired. Several methods have been used to join terminal strip segments, including bending the terminals at the ends of the segments around each other, or wiring, taping, riveting, or wrapping the ends of the segments together. Many of these techniques create projections, such as bent terminals or loose wires, which can snag or tangle other portions of the terminal strip wound on the same reel and which can cause jamming and inefficiencies in the equipment which inserts the terminals into plastic housings. In addition, these methods often require the use of tools. As a result, an effort must be made to ensure than the proper tools are readily available.

Once the terminal strips, including any joined terminal strip segments, have been wound onto supply reels, one or more of the reels and a supply of plastic housings are commonly loaded into an automatic terminal insertion machine. The insertion machine cuts a desired number of terminals from the continuous terminal strip and inserts them into a plastic housing. Such machines are capable of producing 35 or more assembled connectors per minute when operating without interruption. Any disruptions of the terminal strip feed or insertion operations decrease the efficiency of the machine. The efficiency of the insertion machine may be defined as the number of assembled connectors actually produced over a given time span compared with the number which could have been produced with uninterrupted operation at a target assembly rate.

The operation of an automatic insertion machine is disrupted in several ways. One way is for the supply of terminals being fed to the machine to be exhausted. When this happens, a new reel of terminals must be mounted on the machine and threaded through various tensioning and guide means, more commonly known as the feed track. Threading a new terminal strip into the insertion machine may take two or more minutes, resulting in lost production of 70 or more assembled connectors on a machine which can produce 35 connectors per minute. The total time lost installing new reels on the machine over the course of a shift can be minimized by increasing the number of terminals on each reel.

Another way in which the operation of an automatic insertion machine is disrupted is for it to encounter joints at which terminal strip segments have been joined together in one of the ways described above. It is not uncommon for each reel to have six to ten or more such joints. Because the joints tend to have projections which can snag or tangle parts of the machine, the joints frequently tangle or jam while passing through the feed track of the insertion machine. An operator must clear the jam by removing the jammed terminal strip from the machine and refeeding a fresh terminal strip through the feed track. As with feeding a fresh reel, each refeeding operation after a jam results in the loss of production time. For example, if each reel had six joints between terminal strip segments, an operator would have to feed or refeed the machine a total of seven times—once when the reel was fresh and once for each of the six joints. As a result, fourteen minutes or more of production time could be lost while processing the reel. Even more time could be lost if any particularly extensive jamming occurs.

A more serious situation arises if the joints between terminal strip segments enter the terminal cutting and insertion portion of the terminal insertion machine undetected. The dies used to cut the terminals are precision, close-fit tools which can be damaged or completely destroyed if a wire or bent terminal is in place between the dies as they close. Therefore, the joints must be removed from the terminal strips before reaching this portion of the machine. Removal would be facilitated if joints between terminal strip segments were made in a consistent manner which would allow them to be detected before they enter this portion of the machine. However, the joints are difficult to automatically detect, especially when terminals are being processed at high speeds, because they tend to resemble a good strip of terminals and because heretofore there has been no uniformity in the way in which terminal strip segments are joined.

Even if the joints between terminal strip segments could be detected automatically, the terminal insertion machine would have difficulty automatically processing them because the methods used to create the joints do not maintain a uniform terminal spacing at the joints. Therefore, it would be desirable if terminal strip segments could be joined in a way which maintains a uniform terminal spacing.

Accordingly, it is desirable to have a means for joining terminal strip ends in a consistent manner which does not require the use of tools, which lends itself to automatic detection, which does not cause jamming or tangling while the terminals strips are fed to an automatic terminal insertion machine, and which maintains a uniform terminal spacing between adjacent terminal strip segments.

DISCLOSURE OF THE INVENTION

The present invention is a means for joining terminal strip segments in a consistent manner which does not require the use of tools, which lends itself to automatic detection, which does not cause jamming or tangling when the terminals strips are fed to an automatic terminal insertion machine, and which can maintain a uniform terminal spacing between adjacent terminal strip segments.

One aspect of the invention includes a joiner with identical, hermaphroditic first and second joiner halves. Each joiner half has an optically detectable solid body, means extending from the solid body for engaging a pilot hole on a terminal strip segment, and means extending from the solid body for securely grasping another joiner half. When assembled into a joiner, the first joiner half is capable of engaging a pilot hole on a first terminal strip segment and securely grasping the second joiner half. The second joiner half is capable of engaging a pilot hole on a second terminal strip segment and securely grasping the first joiner half to join the two terminal strip segments together. The solid body enables the joiner to be easily detected against a background of a continuous strip of terminals, to avoid jamming or tangling, and to maintain a uniform terminal spacing. Because the joiner halves are hermaphroditic, only a single part is needed to build the joiner.

Another aspect of the invention includes a method of joining two terminal strip segments. A pilot hole on a first terminal strip segment is engaged with a means for engaging a pilot hole on a terminal strip segment located on a first joiner half, while a pilot hole on a second terminal strip segment is engaged with a means for engaging a pilot hole on a terminal strip segment located on a second joiner half. A joint is formed between the first and second terminal strip segments by securely grasping the first joiner half to the second joiner half with means for securely grasping another joiner half located on the first joiner half and securely grasping the second joiner half to the first joiner half with means for securely grasping another joiner half located on the second joiner half.

Another aspect of the invention includes a method of using a joiner. First and second terminal strip segments are joined with a joiner as described above and are wound onto a terminal strip supply reel as part of a continuous strip of terminals. The terminal strip supply reel is loaded onto an automatic terminal insertion machine and the continuous strip of terminals is threaded through tensioning and guide means on the automatic terminal insertion machine. The presence of the joiner on the continuous terminal strip is automatically detected and the joiner is removed from the terminal strip segments. The first and second terminal strip segments are properly fed to a terminal cutting device in the terminal insertion machine.

The foregoing and other advantages of the present invention will become more apparent from the following description and accompanying drawings.

BEST MODE FOR CARRYING OUT THE INVENTION

The present invention is a means for joining terminal strip segments in a consistent, easily discernible manner which prevents tangling and jamming in automatic terminal insertion machines. Each joiner of the present invention comprises two identical joiner halves which snap together around the ends of a terminal strip segment. The joiner holds the ends together while the terminal strip is fed through the tensioning and guide means of the insertion machine. The tensioning and guide means will be referred to as the feed track.

Figure 1:
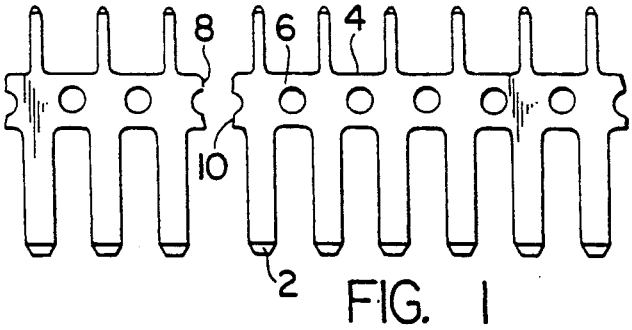
FIG. 1 is a plan view of two terminal strip segments which should be joined into a single terminal strip.

FIG. 1 depicts two typical terminal strip segments which should be joined to facilitate feeding a continuous strip to an automatic insertion machine. Each terminal strip segment comprises a plurality of individual terminals 2 which are joined to each other by thin metal segments 4. Each metal segment has a pilot hole 6 which aids in feeding the terminal strip into an automatic insertion machine. The terminal strip ends 8, 10 are then created by breaks in the continuous terminal strip which occur during fabrication or while the strip is wound onto a supply reel.

Figure 2:
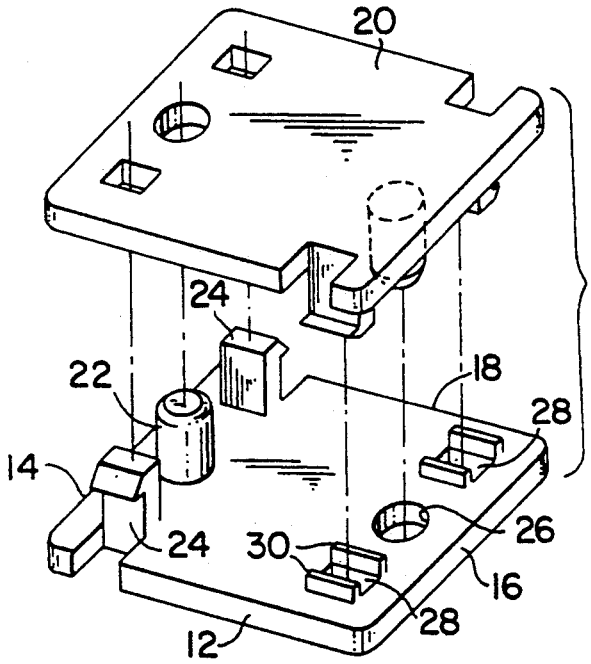
FIG. 2 is an exploded, isometric view of a joiner of the present invention which is suitable for joining the terminal strip segments shown in FIG. 1.

As shown in FIG. 2, a typical joiner half of the present invention has a rectangular body 12 with a male side 14, a female side 16, an inside face 18, and an outside face 20. The body 12 is large enough to be automatically detected by an electric eye or similar detection means on an automatic insertion machine. A cylindrical post 22 and .two locking fingers 24, also known as snap hooks, extend from the inside face !8 of the body. The post 22 is located at the centerline of the body 12 along the male side 14. The post 22 is sized to pass through the pilot hole 6 of the terminal strip for which the joiner is designed and is long enough to pass though both the pilot hole 6 and a post hole 26 of another joiner half. The post 22 is chamfered to make it easier to pass through pilot hole 6 and post hole 26. The locking fingers 24 are aligned with the post 22 along the male side 14 of the body, offset somewhat from the centerline. The post hole 26 and two latch holes 28 pass through the body 12 from the outside face 20 to the inside face 18 on the female side 16 of the body. The post hole 26 and latch holes 28 are sized and positioned so that a post 22 and locking fingers 24, respectively, of an identical joiner half can be pushed through them. The post 22 and locking fingers 24 are spaced from the post and latch holes 26, 28 such that the spacing between the terminals at the joint between terminal strip segments is identical to the spacing between terminals on the unbroken portions of the terminal strip. The locking fingers 24 are sized to fit between adjacent terminals 2 on a terminal strip as shown in FIG. 1 and are positioned so they straddle the metal segment 4 which connects adjacent terminals to prevent adjacent terminal strip segments from rotating more than a few degrees with respect to each other around the joiner. A pair of ridges 30 is positioned on the inside face 18 of the body on either side of the latch holes 28 to aid in maintaining the desired angular alignment of the terminal strip segments with respect to each other and the joiner.

Each joiner half is hermaphroditic, that is, it has both male and female connections. This makes assembly easier because there can be no confusion about which parts are needed to make up a joiner and no need to maintain inventories of two different joiner halves. The design of the joiner permits it to feed smoothly from the reel and into the feed track of an automatic terminal insertion machine without jamming or tangling because it does not have any projections which can snag or tangle with the terminal strip or parts of the machine as can prior art joiners. Moreover, the body can be sized to provide the clearances necessary for the joiner to pass through the feed track without jamming. The preferred arrangement of posts and locking fingers directs axial load forces to the posts, rather than to the locking fingers, permitting the joiners to be subjected to high loads without opening up or breaking apart.

The joiner halves may be fabricated from any material which will permit the joiner to sustain the axial loads encountered in processing. Preferably, the joiner will be made from a solid, dark, nonreflective material to make it possible to visually detect against a background of reflective metal terminals. The preferred material for the joiner is 6/6 nylon because it possesses the necessary strength, is inexpensive, and is easily available. Any conventional fabrication method, such as injection molding, can be used to make the joiner. Injection molding is preferred because it permits all of the features of the joiner to be easily fabricated.

Figure 3:
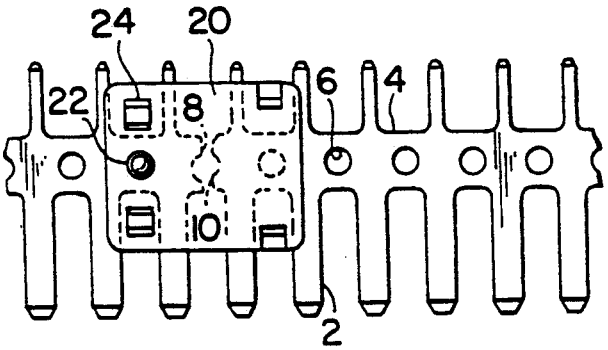
FIG. 3 is a plan view of the terminal strip segments shown in FIG. 1 joined by the joiner shown in FIG. 2.

FIG. 3 depicts an assembled joiner as it joins the terminal strip segments shown in FIG. 1. Prior to assembling the joiner, the segment ends 8, 10 should be trimmed to ensure that they do not interfere with the posts and locking fingers of the joiner halves. Assembly is straightforward, requiring only that the posts of the two joiner halves be passed through pilot holes in the terminal strip and the joiner halves be snapped together. No tools are needed to assemble the joiner. In the preferred embodiment, the joiner is designed so that the spacing between the terminals on the joined broken ends is identical to the space between the terminals on an unbroken portion of the terminal strip. Maintaining a constant spacing can permit the joined broken ends to be handled automatically in a terminal insertion machine. Once assembled, the joiner can be automatically detected with an electric eye or similar detection means because it disrupts the regular pattern of terminals and pilot holes on the strip.

Figure 4:
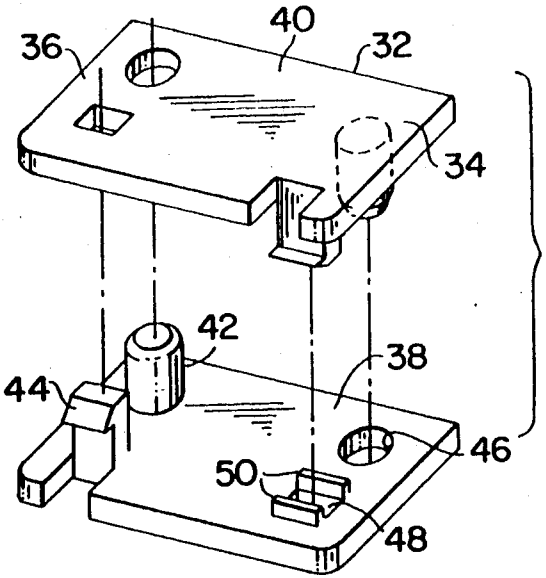
FIG. 4 is an exploded, isometric view of an alternate embodiment of the joiner of the present invention.

FIG. 4 depicts an alternate embodiment of the joiner of the present invention. Such a joiner may be used in situations which do not require adjacent terminals at the joint to have the same spacing or alignment as terminals on the rest of the terminal strip. The joiner may be molded in this configuration or may be made by cutting a joiner like the one shown in FIG. 2 in half.

Figure 5:
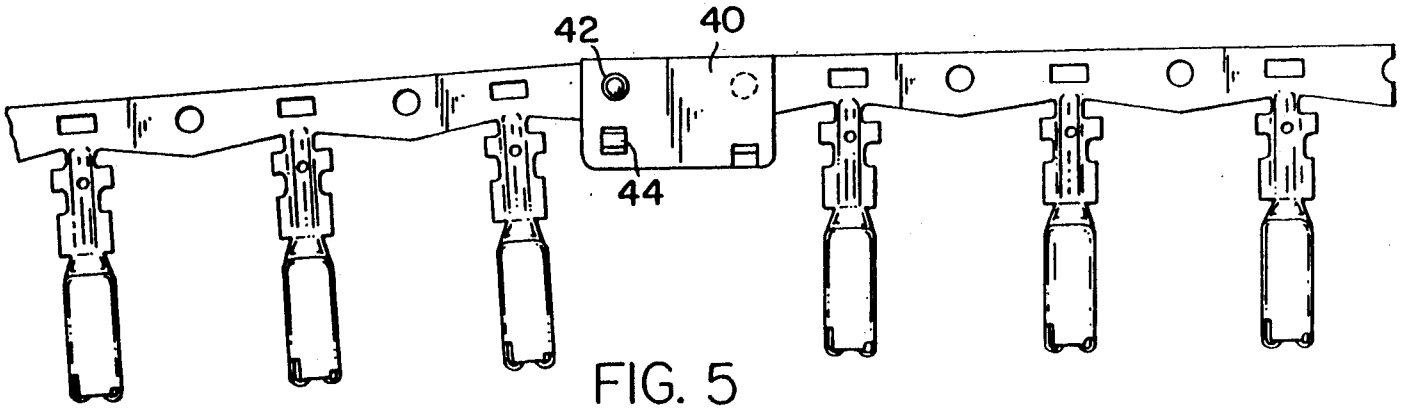
FIG. 5 is a plan view of two terminal strip segments joined by the joiner shown in FIG. 4.

The joiner half has a rectangular body 32 with a male side 34, a female side 36, an inside face 38, and an outside face 40. A cylindrical post 42 and a locking finger 44 extend from the inside face 38 of the body. The post 42 is sized to pass through a pilot hole of a terminal strip for which the joiner is designed and is long enough to pass though both the pilot hole and a post hole 46 of another joiner half. The post 42 is chamfered to make it easier to pass through pilot hole and post hole 46. A post hole 46 and a latch hole 48 pass through the body 32 from the outside face 40 to the inside face 38 on the female side 16 of the body. The post hole 46 and latch hole 48 are positioned so that a post 42 and locking finger 44, respectively, of an identical joiner half can be pushed through them. A pair of ridges 50 is positioned on the inside face 38 of the body on either side of the latch holes 48. FIG. 5 depicts the joiner connecting two segments of female terminals.

A joiner of the present invention may be manually attached to terminal strip segments at any stage in the terminal manufacturing process at which a break in the continuous terminal strip occurs. For example, the joiner may be attached to terminal strip segments during the terminal stamping operation or during a plating operation. Although the joiners can be fed through the insertion machine's feed track without jamming or tangling because they have no snag-prone projections, they must be removed from the terminal strips before they reach the terminal cutting and insertion portion of the machine so they do not interfere with these operations. If the joiners are not removed from the terminal strips after entering the insertion machine, they may damage the cutting dies and insertion devices. The joiners may be removed manually or automatically.

Manual removal of the joiners may be facilitated by an automatic sensing device on the machine which identifies the presence of a joiner, stops the machine, and alerts an operator. The device may be an electric eye or similar device which scans the terminal strip as it is fed to the machine to detect any disruption of the regular pattern of terminals or pilot holes caused by the presence of a joiner. The sensing device should be placed after the feed track, but before any parts of the machine which can be damaged by the joiner. Once the machine alerts an operator, the operator cuts away the joiner and ensures that the broken terminal ends feed properly into the machine. This manual operation can be done in about 15 to 20 seconds. Because the joiner is removed after the terminal strip has already threaded itself through the feed track, there is no need to rethread a new terminal strip. As a result, this procedure saves considerable time over the prior methods used to join terminal strips. The lower refeed time substantially improves the efficiency of the machine. Terminal insertion machines incorporating an automatic sensing device may be purchased from any of a number of automated equipment manufactures, including Bodine Corporation (Bridgeport, Conn.) and Dial-X Automated Equipment, Inc. (Albion, Ind.).

It is also possible for the terminal insertion machine to automatically remove the joiners. In this case, rather than stopping and alerting an operator when it senses the presence of a joiner, the machine itself cuts away the joiner and ensures that the ends of the terminal strip segments properly feed into the machine. Automatic removal of the joiner is facilitated by maintaining a uniform spacing between terminals on adjacent segments. Such a machine permits continuous operation and therefore, maximum efficiency. Such machines may also be purchased from automated equipment manufacturers.

The joiner can, of course, be used with machines and operations other than the terminal insertion machines described herein. The joiner may be useful, for example, with any machine which requires a continuous strip of items to be fed through tensioning and guide means or a feed track before entering a processing section.

The joiner of the present invention provides several benefits over the prior methods of joining terminal strip segments. First, because the joiner has no snag-prone projections, it can feed smoothly from the reel and into the feed track of a terminal insertion machine, thereby reducing the incidence of jamming and tangling which characterize prior art methods.

Second, because the joiner has a large, solid, dark, nonreflective body, it is possible to visually or automatically detect it as it feeds through the machine. As a result, the joiner can be detected and removed from the machine at a point before it causes any damage and where the refeed time is reduced. Because the joiner can run through the feed track smoothly, it is possible to design a terminal insertion machine which can remove the joiner automatically once it reaches the terminal cutting and insertion portion of the machine.

Third, because the joiner halves are hermaphroditic, only a single part is needed to build the joiner. This makes assembly easier and less confusing. It also means that only a single part need be maintained in inventory. The design of the joiner permits it to be assembled without the use of tools.

Finally, the design of the joiner directs axial loads to the posts rather than the locking fingers. This permits the joiners to withstand higher loads without opening up or breaking apart.

It should be understood that the invention is not limited to the particular embodiment shown and described herein, but that various changes and modifications may be made without departing from the spirit and scope of the claimed invention. For example, the post 22, 42 need not be positioned on the body as shown in FIGS. 2 and 4, but may be located at any convenient point on the body. Similarly, the locking fingers 24, 44 may be located at any convenient point on the body. The spacing between the post 22, 42 and the post hole 26, 46 need not be selected to maintain a uniform spacing between terminals on adjacent terminal strips. Rather, any convenient spacing may be selected. The body 12, 32 of the joiner halves need not be rectangular, but may be any convenient size and shape. Similarly, the post 22, 42 need not be cylindrical, but may be any suitable shape. The locking fingers 24, 44 may also be of any suitable design and size which can securely engage the latch holes 28, 48 on the opposite joiner half. Such locking finger designs are well known in the art.

I claim:

1. A joiner comprising identical, hermaphroditic first and second joiner halves, each joiner half having:

(a) an optically detectable solid body;

(b) means extending from said solid body for engaging a pilot hole on a terminal strip segment; and (c) means extending from said solid body for securely grasping another joiner half;

such that when assembled into a joiner, the first joiner half is capable of engaging a pilot hole on a first terminal strip segment and securely grasping the second joiner half and the second joiner half is capable of engaging a pilot hole on a second terminal strip segment and securely grasping the first joiner half, thereby joining the two terminal strip segments together in a consistent manner which permits the joiner to be automatically detected against a background of a continuous strip of terminals by a terminal insertion machine.

2. The joiner of claim 1 wherein the means for engaging a terminal strip end are spaced to provide a uniform spacing between terminals on adjacent terminal strip segments.

3. The joiner of claim 1 further comprising means for establishing and maintaining a preferred angular alignment between adjacent terminals.

4. The joiner of claim 1 wherein:

(a) the body has an outside face and an inside face;

(b) the means for engaging a terminal strip segment include (i) a post extending from the inside face of the body; and (ii) a post hole extending through the body from the outside face to the inside face positioned and sized to engage a post from a second joiner half; and (c) the means for securely grasping a second joiner half include (i) a locking finger extending from the inside face of the body; and (ii) a latch hole extending through the body from the outside face to the inside face positioned and sized to securely engage the locking finger from the second joiner half.

5. The joiner of claim 4 wherein each joiner half has two locking fingers and two latch holes.

6. A method of joining two terminal strip segments comprising:

(a) engaging a pilot hole on a first terminal strip segment with means for engaging a pilot hole on a terminal strip segment located on a first joiner half;

(b) engaging a pilot hole on a second terminal strip segment with means for engaging a pilot hole on a terminal strip segment located on a second joiner half; and (c) forming a joint between the first and second terminal strip segments by securely grasping the first joiner half to the second joiner half with means for securely grasping another joiner half located on the first joiner half and securely grasping the second joiner half to the first joiner half located on the second joiner half.

7. A method of using a joiner, comprising:

(a) joining first and second terminal strip segments with a joiner according the method of claim 6;

(b) winding a continuous strip of terminals which includes the first and second terminal strip segments onto a terminal supply reel;

(c) loading the terminal strip supply reel onto an automatic terminal insertion machine;

(d) threading the continuous strip of terminals through tensioning and guide means on the automatic terminal insertion machine;

(e) automatically detecting the presence of the joiner on the continuous terminal strip;

(f) removing the joiner from the terminal strip segments; and (g) ensuring that the first and second terminal strip segments are properly fed to a terminal cutting device in the terminal insertion machine.

8. The method of claim 7 further comprising stopping operation and alerting an operator to the presence of the joiner on the continuous terminal strip after step (e).

* * * * *